US006243918B1

(12) United States Patent
Zetti

(10) Patent No.: US 6,243,918 B1
(45) Date of Patent: Jun. 12, 2001

(54) SNAP HINGE

(75) Inventor: Daniele Zetti, Modena (IT)

(73) Assignee: T.G.N. S.p.A., Modena (IT)

( * ) Notice: Subject to any disclaimer, the term of this patent is extended or adjusted under 35 U.S.C. 154(b) by 0 days.

(21) Appl. No.: 09/039,196

(22) Filed: Mar. 13, 1998

Related U.S. Application Data

(63) Continuation of application No. 08/693,127, filed as application No. PCT/EP65/05064 on Dec. 18, 1995, now abandoned.

(30) Foreign Application Priority Data

Dec. 16, 1995 (IT) ..... MO94A0165

(51) Int. Cl.[7] ..... E05F 1/08

(52) U.S. Cl. ..... 16/298; 16/293; 16/366; 16/334; 16/331

(58) Field of Search ..... 16/293, 288, 366, 16/334, 331, 298

(56) References Cited

U.S. PATENT DOCUMENTS 4,236,272 * 12/1980 Gronbach et al. ..... 16/288
4,596,062 * 6/1986 Rock ..... 16/288
4,837,894 * 6/1989 Lin ..... 16/288
5,035,026 * 7/1991 Carlo et al. ..... 16/288
5,058,238 * 10/1991 Lautenschlager ..... 16/288
5,444,985 * 8/1995 Salice ..... 16/288

* cited by examiner

*Primary Examiner*—S. Thomas Hughes
*Assistant Examiner*—Marc Jimenez
(74) *Attorney, Agent, or Firm*—Guido Modiano; Albert Josif; Daniel O'Byrne

(57) ABSTRACT

A snap hinge and method of manufacturing includes a plurality of articulated levers interposed between a first member and a second member and reciprocally angularly positionable between first and second end positions. An elastic member is interposed between the levers and at least one of the levers includes side portions and at least one interconnecting portion between side portions. At least one lever cooperates with the elastic member at hinge means that are only defined by one interconnecting portion. The components are punched from a metal stamp and bent with side portions at right angles to interconnecting portions to form hinge means integrally with the side portions.

4 Claims, 7 Drawing Sheets

FIG. 1
PRIOR ART
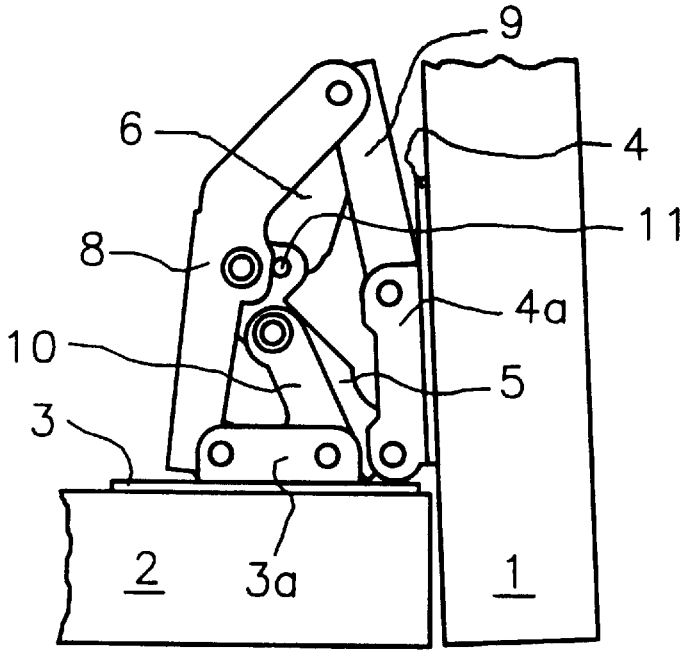
FIG. 2
PRIOR ART
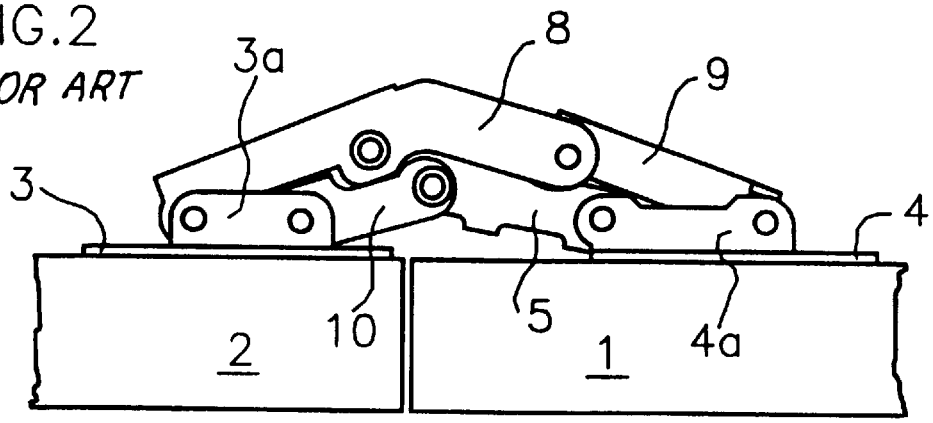
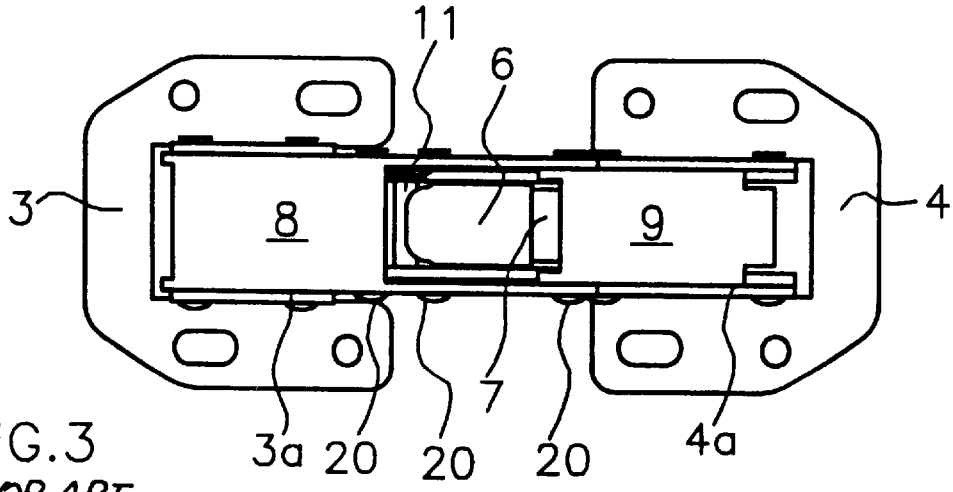
FIG. 3
PRIOR ART FIG.4
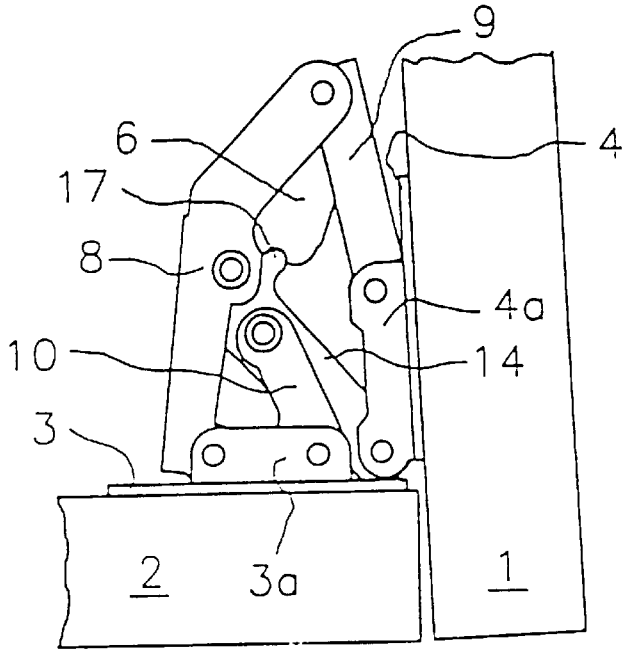
FIG.5
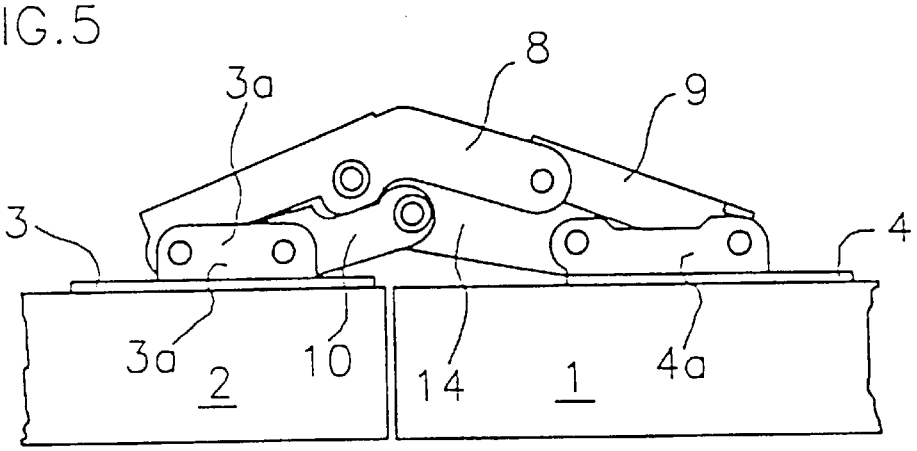
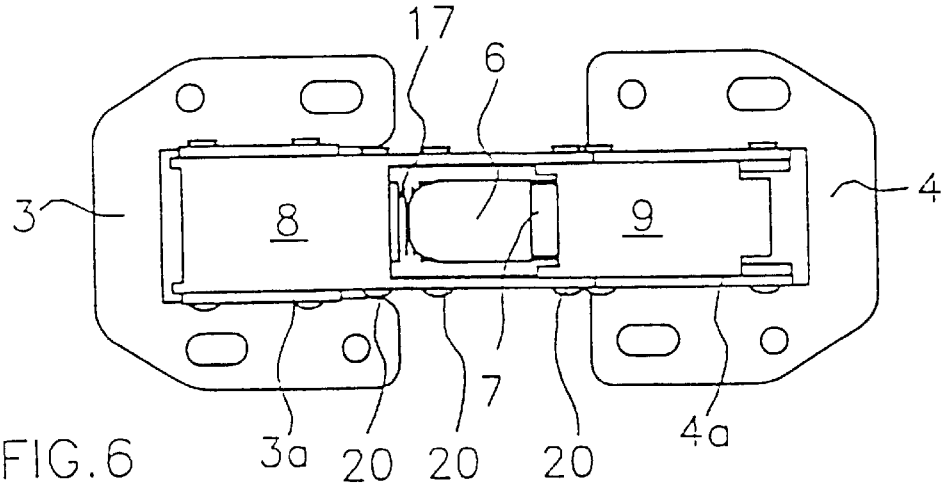
FIG.6

SNAP HINGE

This application is a continuation of application Ser. No. 08/693,127, filed Oct. 10, 1996 now abandoned, which is a 371 of PCT/EP95/05064, filed Dec. 18, 1995.

BACKGROUND OF THE INVENTION

The invention concerns an improved snap hinge for furniture, that is, a hinge that articulates, on the body of the piece of furniture, for example, doors and panels. The furniture may be made of wood, metal or other materials. The hinge is of the type that allows a snap opening and closing of the door or panel of the piece of furniture, the opening angle being of about 90°.

The related art includes a non-recessed snap hinge, disclosed in the patent IT-A-953903, filed on Oct. 8, 1973, in the name of the same applicant. In such prior document a hinge is disclosed which is of the double articulated quadrilateral type, allowing snap opening and closing of the doors, with the opening angle being of approximately 90°, in fact slightly more than 90°.

In this known, non-recessed type of hinge, shown in the enclosed FIGS. 1, 2, 3, 7, 9, 11, 12, 13, the lever, loaded by a snap spring inserted in a telescopic capsule having a base plate with a bottom recess, consists mainly of a pair of side elements with an elongated shape, which are interconnected by bridging elements. The side elements are shaped so as to define two opposite sides, a ventral and a dorsal one, with the bridging elements located on the dorsal side.

A ventral pin made of hardened steel, on which the bottom recess, with semi-circular cross-section, of the base plate is designed to fit, constitutes a further and separate component of the lever. The telescopic capsule also includes a telescopic cover, enclosing the snap spring that bears with an end on the base plate to provide, in combination with said lever, the snap opening and closing of said hinge.

Moreover, such a pin, whilst being functionally adequate, has to be manufactured, including the necessary hardening and protection treatments, separately from the structure of the lever. The latter, on the other hand, is entirely made in a single die, during a single passage of the blank strip. Eventually, the pin has to be riveted to the lever for final assembly.

The separate manufacture of the pin and the additional riveting operation entail significant manufacturing costs.

SUMMARY OF THE INVENTION

The described prior art may be considerably improved by eliminating the above mentioned drawbacks and notably reducing manufacturing costs.

From the foregoing the need emerges to solve the technical problem of producing a simplified, less expensive lever for a snap hinge, on which a snap spring may effectively act to determine the snap opening and closing.

The present invention solves said technical problem by providing, in a snap hinge for furniture, a rotational coupling element suitable to operate between the base plate of the telescopic capsule and the lever. The coupling element comprises a bridging element, united so as to form a single piece with the side elements of the very lever, and located on the ventral side of the lever, i.e. on the opposite side with respect to the known dorsal bridging elements.

The lever structure is advantageously strengthen by a single, second ventral bridging element.

A smooth fitting of the bridging element acting as a pin, according to the present invention, into the recess of the base plate of the telescopic capsule, is provided by shaping the coupling surface of said bridging element so as to have a substantially rounded configuration. Such a configuration is obtained, advantageously, through an upsetting operation during which the edges of the bridging element are suitably chamfered.

The advantages of the present invention derive from the fact that, for providing a snap hinge with a coupling joint between a lever and the base plate of the telescopic capsule which has the same efficiency as the one of the conventional pin joint, simpler and fewer manufacturing operations are required, with consequent considerable cost reductions.

A cost reduction is first of all obtained by replacing the treated, coated and riveted conventional pin with a ventral bridging element, connecting the pair of side elements forming the lever, and made from the same blank piece and during the same operation as the side elements.

A further advantage is that of eliminating the dorsal bridging elements of the known lever, which are replaced, in the hinge according to the present invention, with one, single complementary ventral bridging element. All the manufacturing operations are still advantageously performed in a single die, chamfering included.

BRIEF DESCRIPTION OF THE DRAWINGS

A preferred embodiment of the invention is illustrated by comparison with the mentioned prior art device, purely by way of example, in the drawings attached, in which:

FIG. 1 is a side view of the hinge of the type not requiring recessing in the piece of furniture, fitted to a piece of furniture in the closed position, and object of the prior art patent in the name of the same applicant;

FIG. 2 is the side view of the hinge in FIG. 1, but in the completely open position;

FIG. 3 is the plan view of the hinge in FIG. 1;

FIG. 4 is a view as in FIG. 1, but relative to the improved snap hinge object of the present invention;

FIGS. 5, 6 are, respectively, a side view in the configuration with open panel and a plan view of the improved hinge in FIG. 4;

DESCRIPTION OF THE PREFERRED EMBODIMENTS

Figure 7:
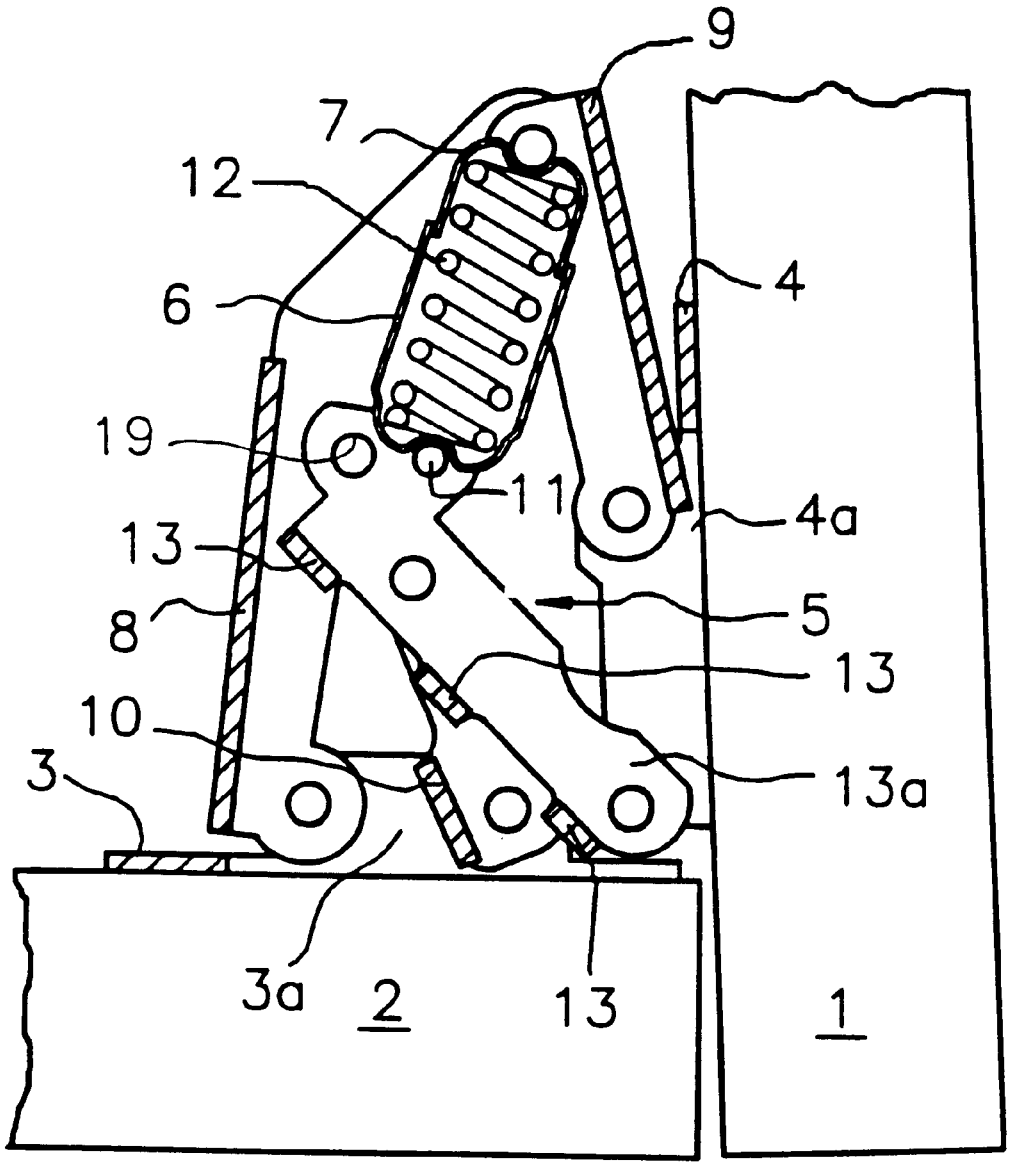
FIG. 7 PRIOR ART
FIG. 7 is an enlarged view of the hinge of FIG. 1, cross-sectioned on a central plane.
Figure 8:
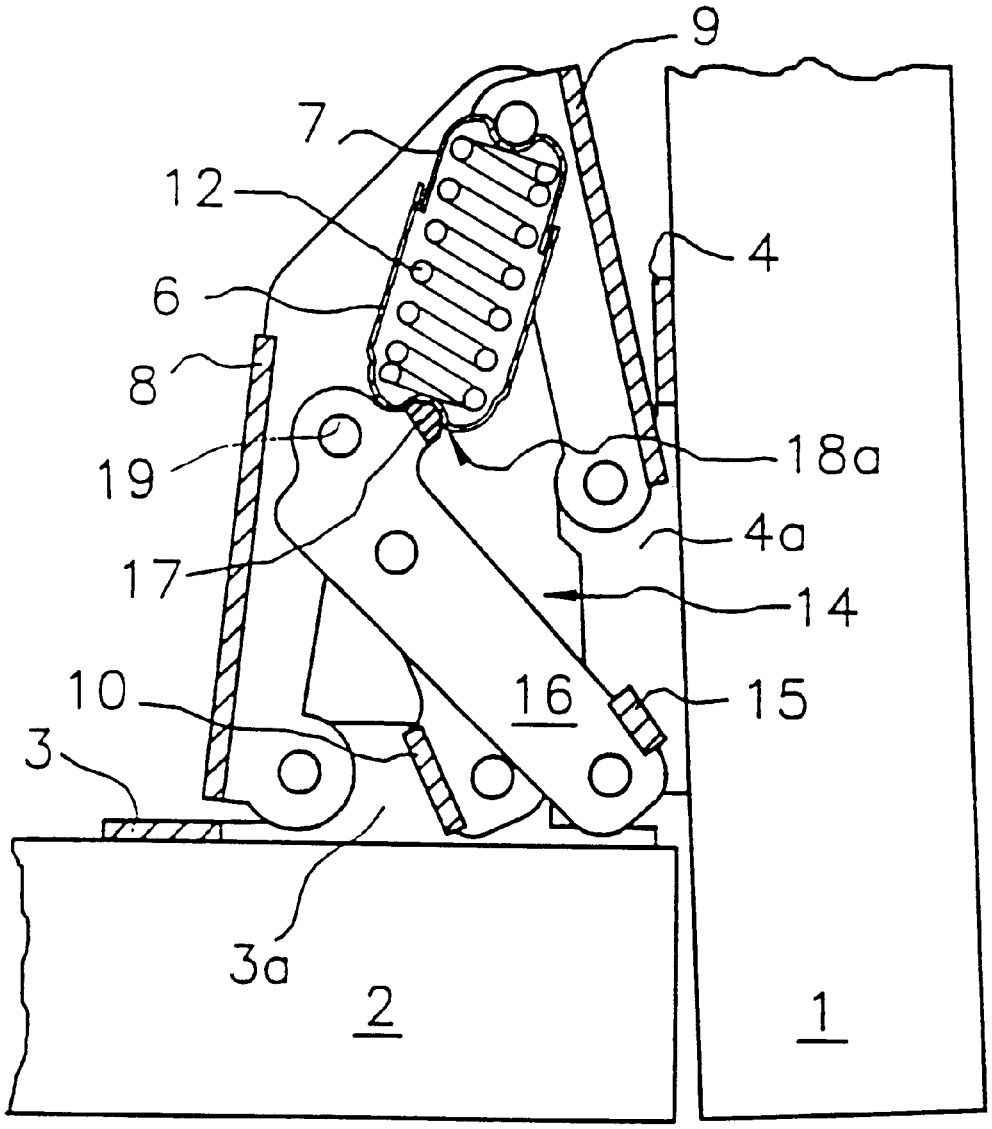
FIG. 8 is, similarly, an enlarged and cross-sectional view of the hinge of FIG. 4.

With reference to the drawings, in the enclosed figures, the improved hinge of the present invention is shown (in FIGS. 4–6, 8, 10 and 14–16) by comparison with a state-of-the art hinge (FIGS. 1–3, 7, 9, and 11–13).

The same reference numerals designate, in the figures mentioned above, similar or equivalent hinge parts.

In particular, two conventional attachment plates 3 and 4 are shown, connected to a door 1 and to the frame shoulder 2 of a generic piece of furniture, respectively. The attachment plates 3, 4 are equipped with respective base pairs 3*a* and 4*a* for the interconnection of double quadrilateral hinge elements.

The hinge further comprises a lever 5, loaded by a snap spring 12 contained in a cup-shaped base plate 6 provided with a telescopic cover 7 that slides inside said base plate. The whole assembly constitutes a telescopic capsule. The lever 5 and two conventional arms 9 and 10, along with a dorsal lever of the quadrilateral type 8, complete the hinge system.

The hardened ventral pin 11, as a separate component of the prior art hinge, is mounted transverse to the lever 5 and is loaded by said snap spring 12 (FIGS. 7, 8), through the base plate 6 which is rotationally fitted on the pin.

On the conventional lever 5 (FIG. 7), a set of three dorsal bridging elements 13 connecting the side elements 13*a*, are provided.

Instead, the lever 14, according to the invention, (FIG. 8) is loaded by the same snap spring 12 of the hinge of FIGS. 1, 2, 3, has an analogous function to that of said lever 5, but, has only two bridging elements 15 and 17 which are ventral, not dorsal. The first bridging element 15 connects the two side elements 16 (equipped with anti-seizure protrusions) and the second bridging element 17 (FIGS. 4, 6, 8) constitutes a crosspiece with prismatic section, obtained along with, and from the same blank piece as the side elements 16. The element 17 is fitted into a recess 18*a* of the base plate 6, substituting thus the conventional ventral pin 11.

The bridging element 17, has a substantially rounded configuration to provide a smooth fitting into the recess 18*a*. This configuration is achieved by making, advantageously through an upsetting operation carried out in a die, a pair of chamfers 18 (FIGS. 14, 15, 16) at the edges of the bridging element 17.

In fact, through the upsetting operation, the dorsal surface of said bridging element 17 acquires a semi-polygonal broken line perimetrical profile, which is suitable for a better rotational coupling with the recess 18*a* having a semi-circular cross-section and being located at the bottom of the base plate 6.

Figure 14:
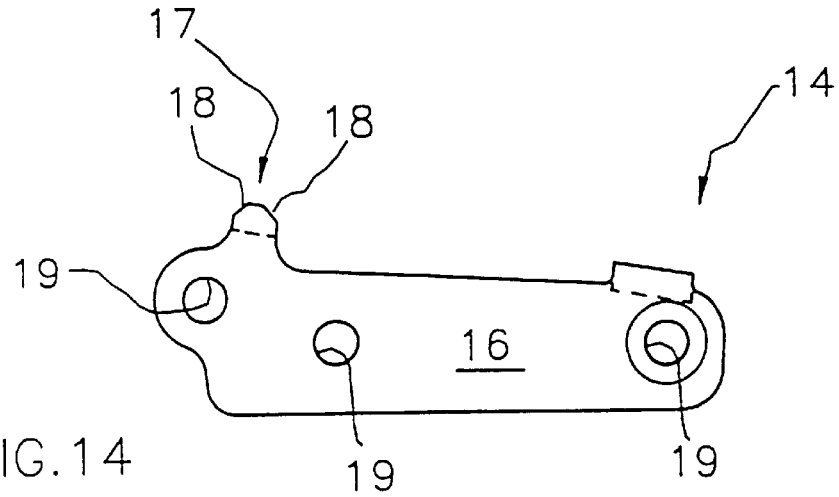
FIGS. 14, 15, 16 are views, similar to that of the FIGS. 11–13, of the levers of the improved hinge according to the present invention.
Figure 15:
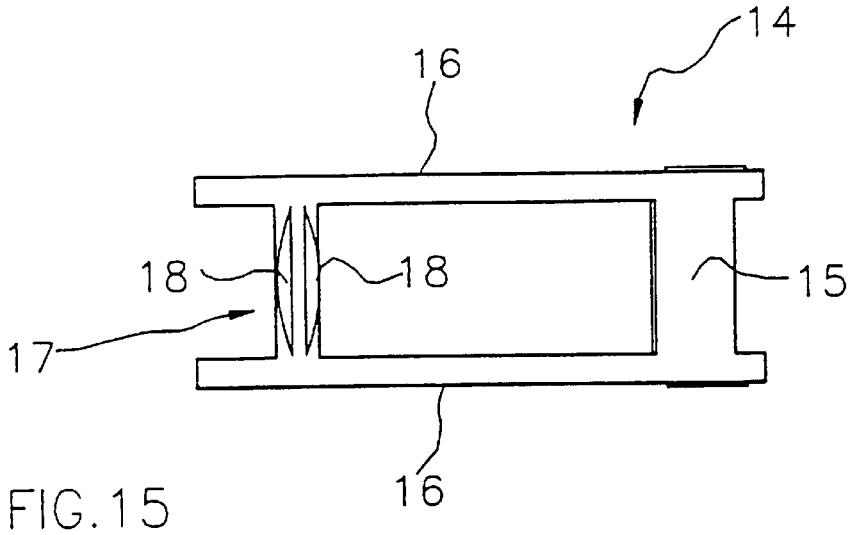
Figure 16:
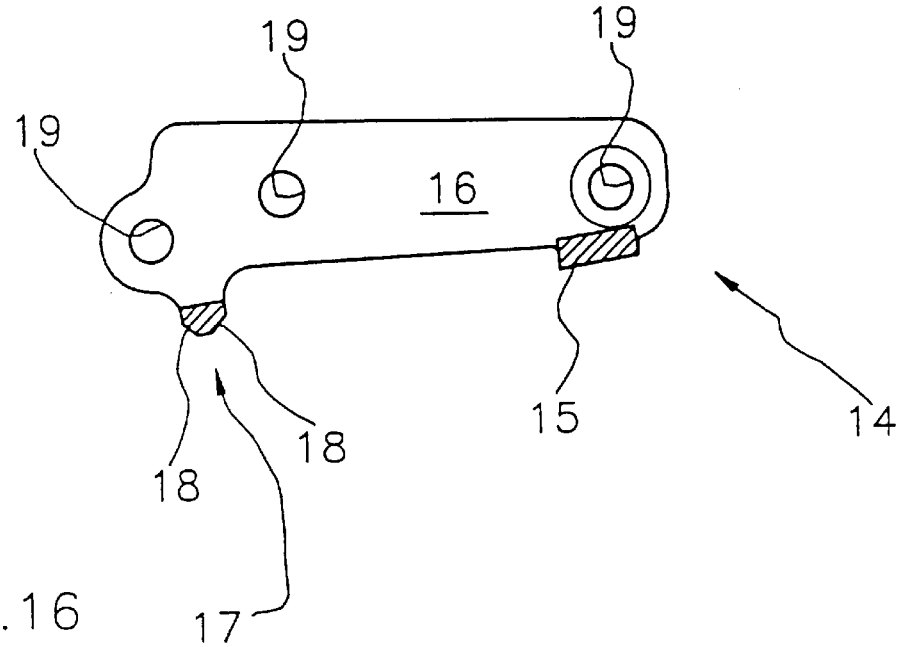

The lever 14 is also provided with three corresponding holes 19, in the two side elements 16, allowing insertion of pins 20 (see FIGS. 6, 14 and 16).

Figure 9:
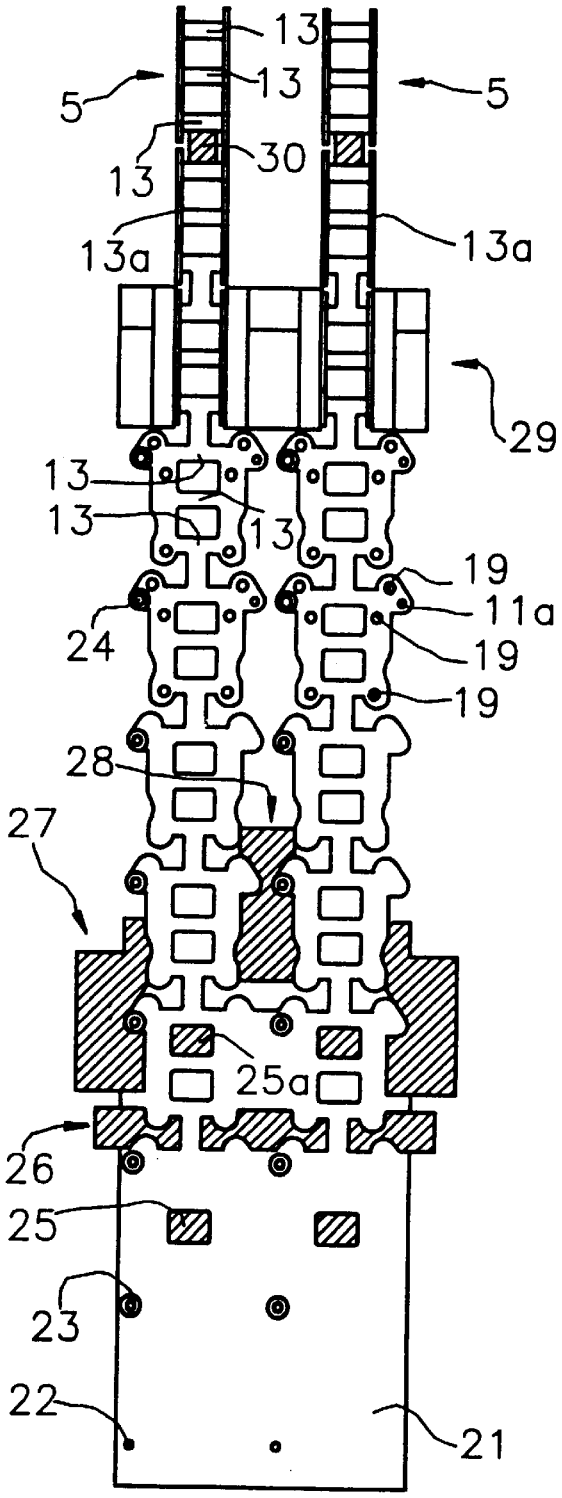
FIG.9 PRIOR ART
FIG. 9 is the plan view of a strip of sheet metal undergoing successive punching, folding and drawing operations to manufacture the spring loaded lever for the snap hinge described in the prior art patent, the punching tools being shown in cross-section with dashed lines.
Figure 10:
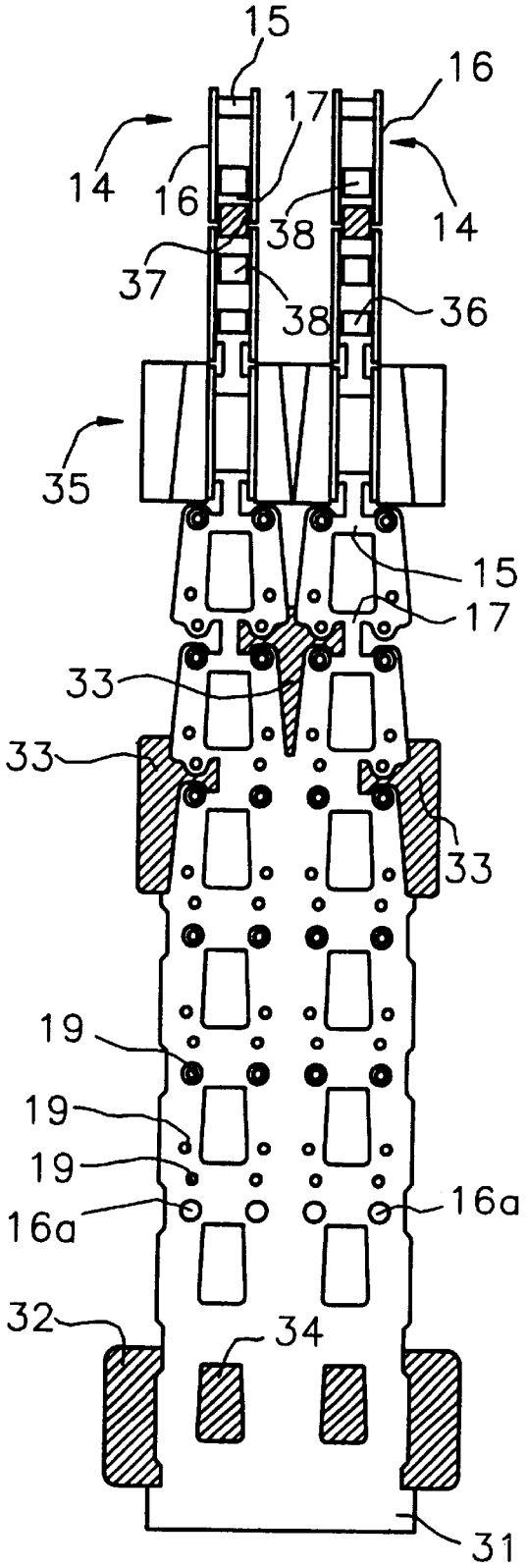
FIG. 10 is an analogous view to FIG. 9, but in the case of the manufacture of the improved lever as described in the invention.
Figure 11:
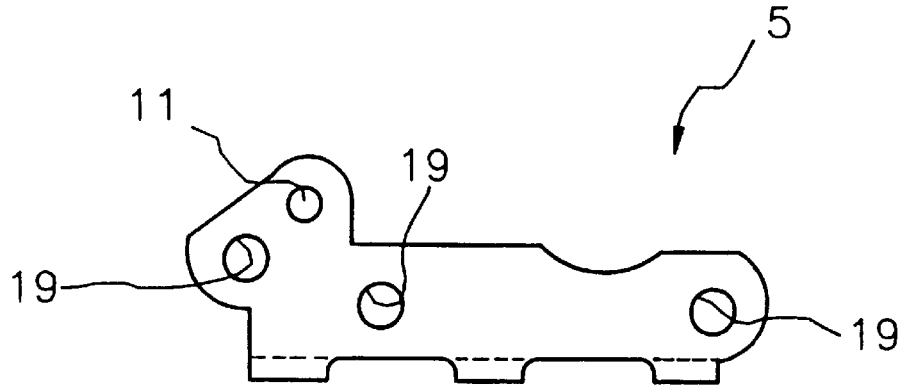
FIG. 11 PRIOR ART
FIGS. 11, 12, 13 are, respectively, the side view, the plan view and the central cross-sectional view of the conventional lever manufactured using the method as illustrated in FIG. 9.
Figure 12:
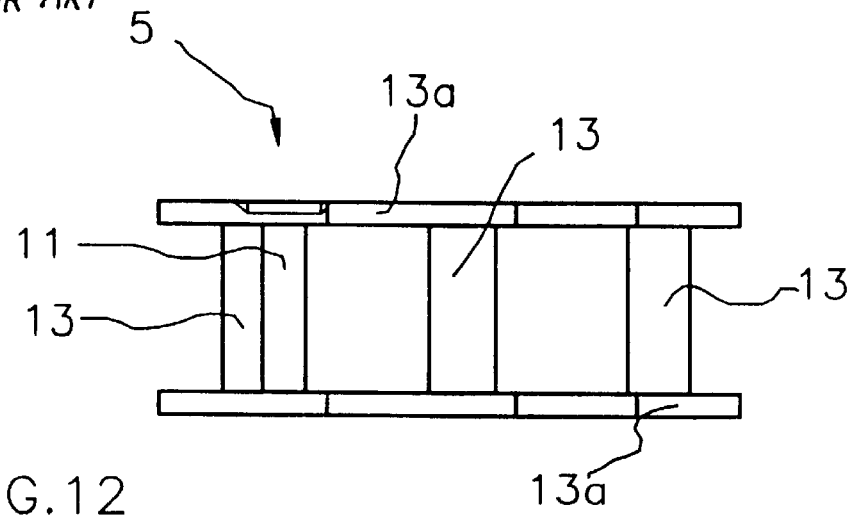
FIG. 12 PRIOR ART
Figure 13:
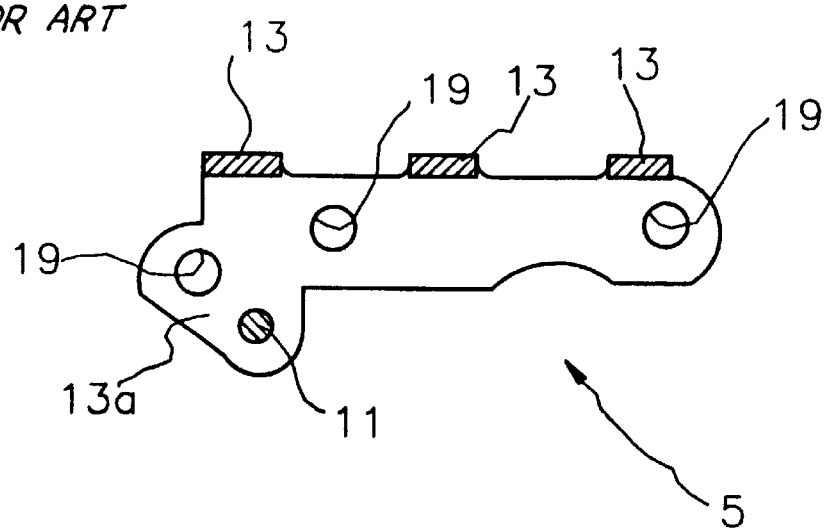
FIG. 13 PRIOR ART

To obtain, the lever 14, according to the invention, punching operations are carried out, as shown in FIG. 10, advantageously in a single die, unlike in the conventional process for fabricating the lever 5 illustrated in FIG. 9.

In this latter Figure an initial part 21 of a metallic strip (the blank piece) is inserted in dies where adapted punches 25, 25*a* cut pairs of conventional levers 5 with sets of three bridging elements 13, usable in combination with springs 12, in the prior art snap hinge of FIGS. 1, 2, 3.

A series of holes 22, 23 and 24 (repeatedly punched along the two fabrication lines of the strip 21) are respectively punched, drawn and gauged, which constitute the seat for riveting the hardened transverse pin 11 in the conventional hinge, whose opposite seat is designated by 11*a* (FIG. 9).

The reference numerals 26, 27, 28 of the same FIG. 9 designate punches for punching the outline of the lever 5, while the punches 29 act at the die for folding and centering the levers. Further punches 30 are used for the cutting and the final separation of the levers 5 from the metallic strip.

In contrast with the conventional method described, the method according to the present invention (FIG. 10), uses a metallic strip 31, conveniently narrower and thicker than the metallic strip 21, to manufacture the levers 14 with the integral pin 17, by means of an automated procedure, advantageously in a single die.

As shown in FIG. 10, first a pair of gauged shears 32 is used to cut part of the outline of the levers 14 and punching elements 34 define the shape of the bridging elements 15, 17. Downstream, along the processing path, punching elements 33 are provided to further cut the profile of the side elements 16, followed by a series of punches 35 for the folding and centering of the pairs of levers 14.

A pair of punches 36 deforms thereafter, through compression or upsetting, the material by acting on the edge of the external, part of the surface of each bridging element 17, making so one of the chamfers of the pair 18, the other chamfer being made by the final punching elements 37 that separates the levers 14 from the strip 31.

Complementary pairs of centering punches 38 cooperate with the punches 37 to prevent the forward displacement of the metallic material constituting the bridging element 17 during the deformation of the edges, required to obtain the external chamfer 18 of said bridging element.

It is readily apparent from above the description of a preferred embodiment of the invention that the functioning of the new snap hinge is practically the same as that of the conventional one, the new, simplified lever achieving the same effects as the one with the known pin.

In practice the materials, dimensions and the fabrication details, the thickness of the strip portions from which the bridging parts of the lever connected with the side elements are made, and the way in which the other components of the hinge are shaped and coupled may be different from, but technically equivalent to those described in the preferred embodiment of the present invention. Therefore such modifications will be comprised within the scope of the appended claims.

What is claimed is:

1. An improved lever for a snap hinge, comprising: an elongated body having side portions joined together by at least one interconnecting portion, said side portions being in a mutually facing relationship so as to define opposite dorsal and ventral sides of said lever; and hinge means being provided at said ventral side of the lever for cooperation with complementary hinge means of the snap hinge for snap opening and closing of the hinge, wherein the improvement consists of providing a plurality of interconnecting portions, arranged at said ventral side of the lever, with one of said interconnecting portions having a substantially rounded shape for constituting said hinge means.

2. The lever of claim 1, wherein said rounded interconnecting portion constituting said hinge means is constituted by a bridging element provided at edges thereof with a pair of chamfers formed so as to impart to said portion said substantially rounded shape.

3. The lever of claim 1, wherein said interconnecting portions are independent and are substantially coplanar.

4. The lever of claim 3, further comprising at opposite ends thereof pairs of articulation end holes providing articulation points for the lever, said interconnecting portions being located on the same side with respect to an axis passing through said articulation points.

* * * * *